US005704532A

United States Patent [19]

Wey

[11] Patent Number: 5,704,532

[45] Date of Patent: Jan. 6, 1998

[54] STAPLER MAGAZINE ASSEMBLY FOR RETAINING NAILS OF DIFFERENT LENGTHS

[76] Inventor: Fwu-Lai Wey, No. 38 Lane 32, Nan-Ching Road, Taichung, Taiwan

[21] Appl. No.: 681,975

[22] Filed: Jul. 30, 1996

[51] Int. Cl.[6] ..... B25C 1/04

[52] U.S. Cl. ..... 227/109

[58] Field of Search ..... 227/109, 120

[56] References Cited

U.S. PATENT DOCUMENTS

| | | | |
|---|---|---|---|
| 4,524,896 | 6/1985 | Morrell, Jr. | 227/109 |
| 4,749,115 | 6/1988 | Fehrs | 227/109 |
| 5,288,004 | 2/1994 | Johnsson et al. | 227/109 |
| 5,522,533 | 6/1996 | Mukoyama et al. | 227/109 |
| 5,632,431 | 5/1997 | Lin | 227/109 |
| 5,634,582 | 6/1997 | Morrison, Jr. et al. | 227/109 |

*Primary Examiner*—Scott A. Smith

*Attorney, Agent, or Firm*—Morton J. Rosenberg; David I. Klein; Jun Y. Lee

[57] ABSTRACT

A stapler magazine includes a longitudinal channel for slidably receiving nails. A cover is secured to the magazine and has a passage for slidably engaging with the nails. Two guide slots are formed in the cover and perpendicular to the passage. A beam is slidably engaged in the passage of the cover. A plate is engaged on the cover. Two bolts secure the plate to the beam and are engaged through the guide slots for moving the beam in a direction perpendicular to the passage and for moving the beam to engage with the nails of different lengths.

2 Claims, 5 Drawing Sheets

STAPLER MAGAZINE ASSEMBLY FOR RETAINING NAILS OF DIFFERENT LENGTHS

BACKGROUND OF THE INVENTION

1. Field of the Invention

The present invention relates to a stapler magazine, and more particularly to a stapler magazine for retaining nails of different lengths.

2. Description of the Prior Art

Typical staplers comprise a nose and a magazine secured to the nose for receiving nails therein. A spring biased pusher is slidably engaged in the magazine for pushing nails toward the nose so as to be actuated. However, typical magazines may not easily retain nails of different lengths therein. In order to stably retain the nails of different lengths, a complicated configuration is required. However, the magazine also may not be adjusted to fit nails of different lengths.

The present invention has arisen to mitigate and/or obviate the afore-described disadvantages of the conventional magazines for staplers.

SUMMARY OF THE INVENTION

The primary objective of the present invention is to provide a stapler magazine which includes a mechanism for adjusting to fit and to retain nails of different lengths.

In accordance with one aspect of the invention, there is provided a stapler magazine assembly comprising a magazine including a longitudinal axis and including a channel extended along the longitudinal axis for slidably receiving nails, a cover secured to the magazine and including a passage for slidably engaging with the nails, the cover including at least one guide slot formed along a second axis perpendicular to the longitudinal axis, a beam slidably engaged in the passage of the cover, and means securing to the beam and engaging through the guide slot for moving the beam along the second axis and for moving the beam to engage with the nails such that the beam may be moved to engage with and to retain the nails of different lengths in place.

The cover includes a notch formed in parallel to the second axis and define by a pair of walls, a first of the wall includes a plurality of recesses, the securing means includes a plate having a protrusion slidably engaged in the notch, the protrusion including a projection means for engaging with the recesses so as to retain the plate to the cover, the securing means includes a bolt engaged through the guide slot for securing the plate to the beam.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
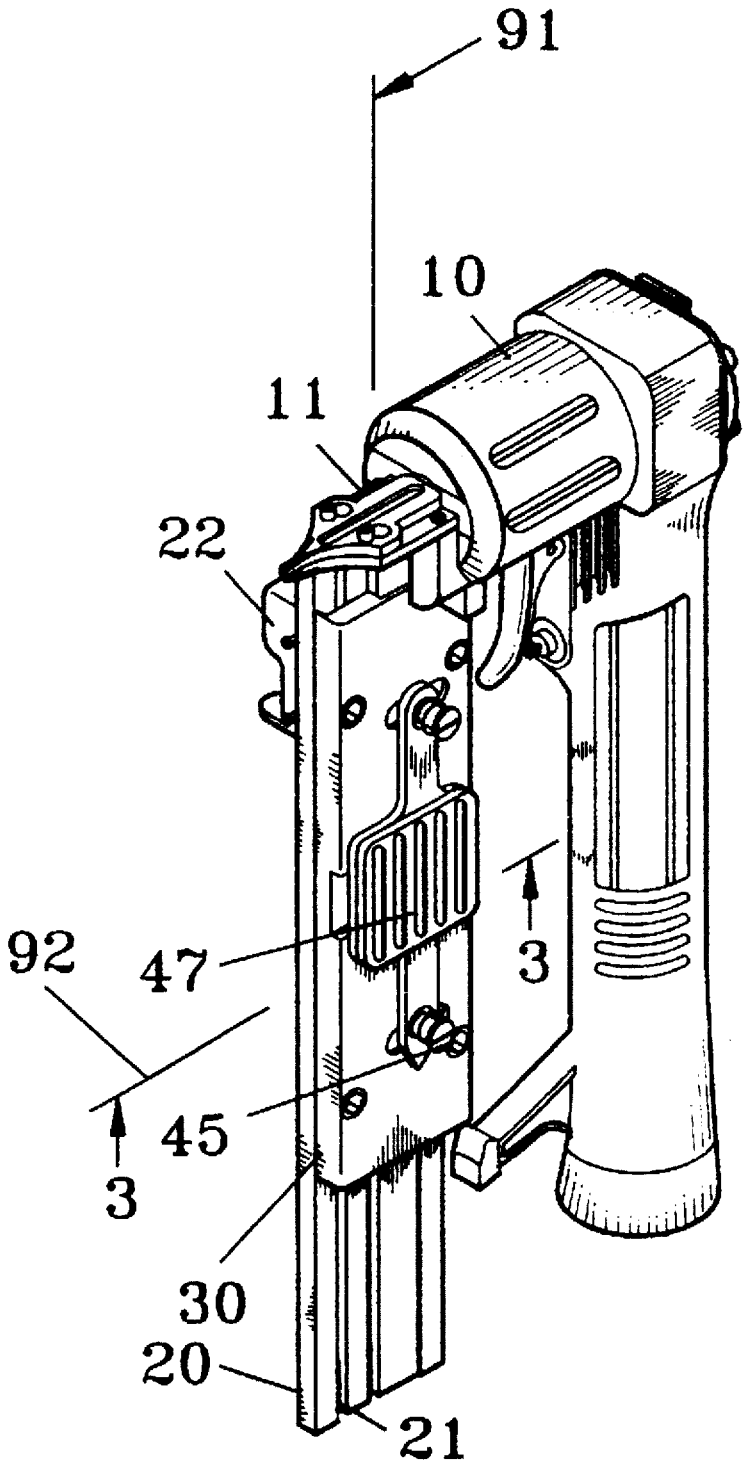
FIG. 1 is a perspective view of a stapler magazine in accordance with the present invention.
Figure 2:
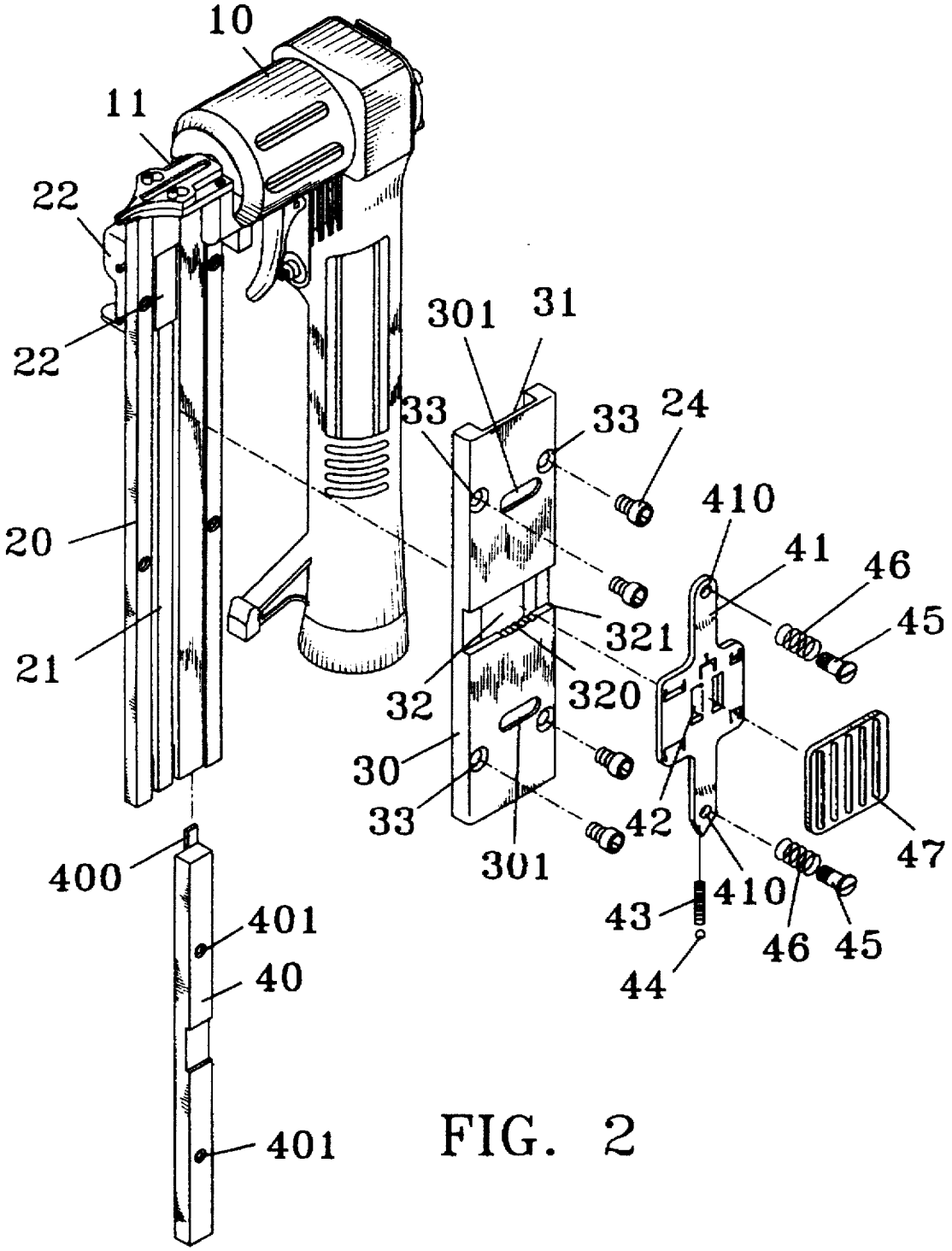
FIG. 2 is an exploded view of the stapler magazine.
Figure 3:
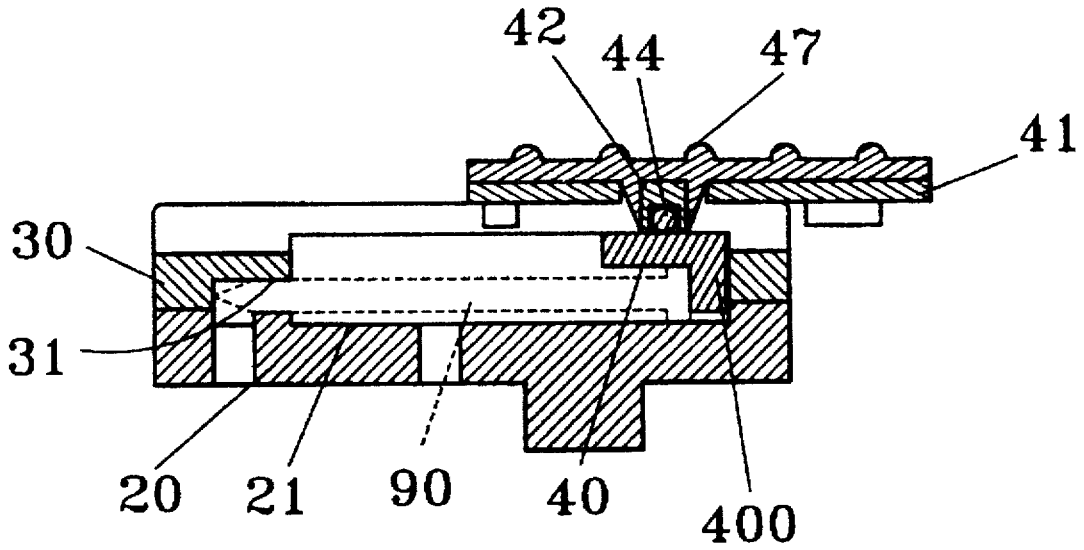
FIGS. 3 and 4 are cross sectional views taken along lines 3—3 of FIG. 9 , illustrating the operation of the magazine.

Referring to the drawings, and initially to FIGS. 1 to 3, a stapler magazine assembly in accordance with the present invention comprises a body 10 including a nose 11 and a magazine 20 having one end secured to the nose 11. The magazine 20 includes a channel 21 formed therein for engaging with and for retaining nails 90 therein (FIG. 3). A spring biased pusher 22 is slidably engaged in the magazine 20 for engaging with the nails and for pushing the nails toward the nose 11 so as to be actuated. A cover 30 includes a number of holes 33 formed therein for engaging with fastening screws 24 which may secure the cover 30 to the magazine 20. The cover 30 includes a passage 31 formed therein for engaging with the nails 90 (FIG. 3) and includes two oblong holes or guide slots 301 formed therein and perpendicular to the longitudinal axis 91 of the cover 30 and of the magazine 20, i.e., the guide slots are arranged in parallel to the axis 92 perpendicular to the longitudinal axis 91 of the cover 30 and of the magazine 20. The cover 30 includes a notch 32 defined between a pair of opposite walls 321. One of the walls 321 includes a number of recesses 320 formed therein.

A beam 40 is slidably engaged in the passage 31 and movable along the direction parallel to the axis 92. The beam 40 includes one or more screw holes 401 formed therein and includes a projection 400 for engaging with the nails 90 (FIG. 3). A plate 41 includes two holes 410 for engaging with fastening bolts 45 which are slidably engaged through the oblong holes 301 of the cover 30 and which are threadedly engaged with the screw holes 401 of the beam 40 so as to secure the plate 41 to the beam 40 such that the beam 40 and the plate 41 move in concert. Two springs 46 are engaged on the bolts 45 and engaged between the heads of the bolts 45 and the plate 41 so as to resiliently bias the beam 40 and the cover 30 toward each other. The plate 41 includes a protrusion 42 extended inward of the notch 32 and having a cavity formed therein for receiving a spring 43 and a ball 44 therein. The ball 44 is biased to engage with either of the recesses 320 so as to position the plate 41 relative to the cover 30. A knob 47 is secured to the plate 41 by such as welding or ratchet teeth engagement method for moving the plate 41 and the beam 40.

Figure 4:
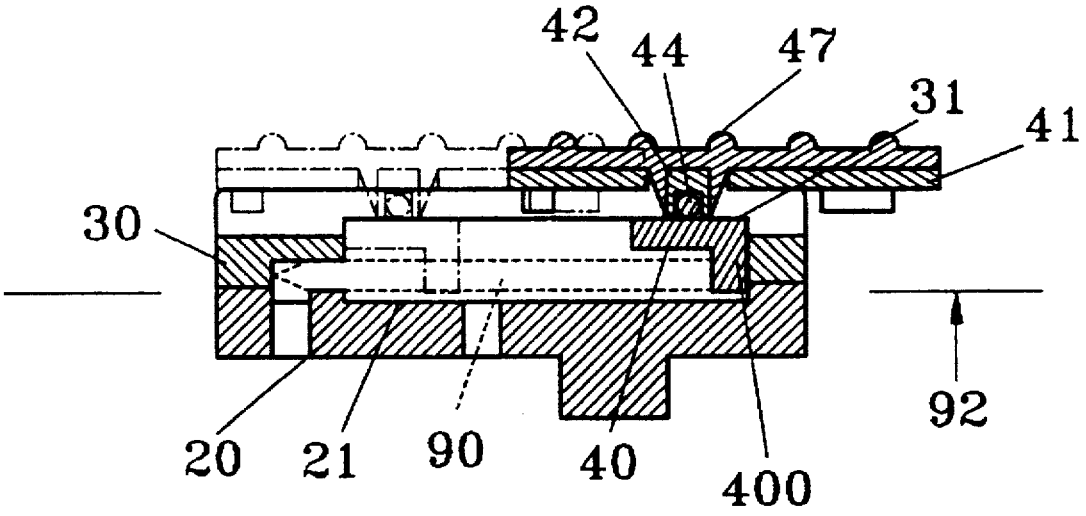
Figure 5:
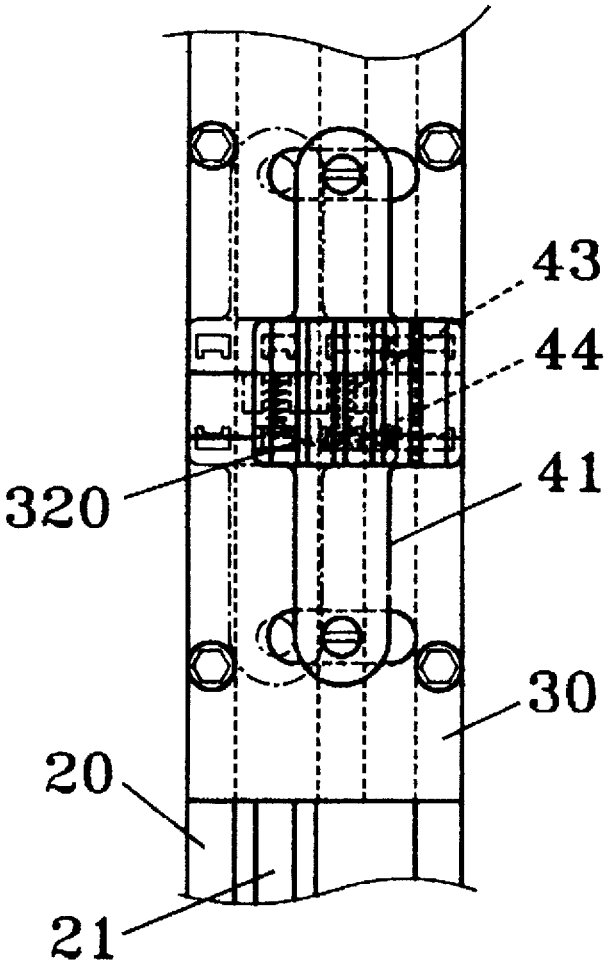
FIG. 5 is a partial plane view illustrating the operation of the magazine to fit nails of different lengths.

In operation, as shown in FIG. 4, when nails of shorter length are engaged in the passage 31, the beam 40 may be moved to engage with the nails 90 (FIG. 4) in order to retain the nails 90 in place when the bolts 45 are forced to slide along the guide slots 301 (FIGS. 2, and 51. The ball 44 may be biased to engage with either of the recesses 320 so as to position the plate 41 relative to the cover 30.

Accordingly, the stapler magazine assembly in accordance with the present invention includes a mechanism for adjusting to fit and to retain nails of different lengths.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A stapler magazine assembly comprising:

a magazine including a longitudinal axis and including a channel extended along said longitudinal axis for slidably receiving nails, a cover secured to said magazine and including a passage for slidably engaging with the nails, said cover including at least one guide slot formed along a second axis perpendicular to said longitudinal axis, a beam slidably engaged in said passage of said cover, and means secured to said beam and engaging through said at least one guide slot for moving said beam along said second axis and for moving said beam to engage with the nails.

2. A stapler magazine assembly according to claim 1, wherein said cover includes a notch formed in parallel to said second axis and defined by a pair of walls, a first of said walls includes a plurality of recesses, said securing means includes a plate having a protrusion slidably engaged in said notch, said protrusion including a projection means for engaging with said recesses so as to retain said plate to said cover, said securing means includes a bolt engaged through said guide slot for securing said plate to said beam.

* * * * *